United States Patent [19]

Bobak

[11] Patent Number: 4,769,859

[45] Date of Patent: Sep. 13, 1988

[54] SANITARY CLOSET WITH TOILET SEAT PROTECTION COVER

[75] Inventor: Tadeusz Bobak, San Francisco, Calif.

[73] Assignee: Incorema, San Francisco, Calif.

[21] Appl. No.: 130,289

[22] Filed: Dec. 8, 1987

[30] Foreign Application Priority Data

Dec. 9, 1986 [CH] Switzerland ..... 4896/86

[51] Int. Cl.[4] ..... A47K 13/18

[52] U.S. Cl. ..... 4/247; 4/242

[58] Field of Search ..... 4/242–247; 242/55.2, 55.3, 55.53

[56] References Cited

U.S. PATENT DOCUMENTS

| | | | |
|---|---|---|---|
| 1,363,085 | 12/1920 | Carlson | 4/247 |
| 1,510,126 | 9/1924 | Yeakel | 4/247 |
| 1,516,803 | 11/1924 | Wheeler | 4/247 |
| 1,696,142 | 12/1928 | Harper et al. | 4/247 |
| 1,967,581 | 7/1934 | Macias | 4/247 |
| 2,024,088 | 12/1935 | Benson | 4/247 |
| 2,987,732 | 6/1961 | Speese | 4/247 |
| 3,961,386 | 6/1976 | Bano | 4/247 |

FOREIGN PATENT DOCUMENTS

| | | | |
|---|---|---|---|
| 586758 | 10/1933 | Fed. Rep. of Germany | 4/247 |
| 419766 | 1/1911 | France | 4/247 |
| 451969 | 5/1913 | France | 4/247 |
| 1461187 | 12/1966 | France | 4/247 |

*Primary Examiner*—Henry K. Artis

*Attorney, Agent, or Firm*—Ostrolenk, Faber, Gerb & Soffen

[57] ABSTRACT

The toilet seat is covered by a protective web of paper having succeeding openings which are congruent with the toilet seat opening. The protection web is transportable transversely over the toilet seat from a supply roll in a cartridge to a take-up roll in another cartridge, by mechanical or electrical driving means.

The two cartridges are supplied wrapped together with the protection web already installed therein and ready for use.

10 Claims, 5 Drawing Sheets

FIG. 1
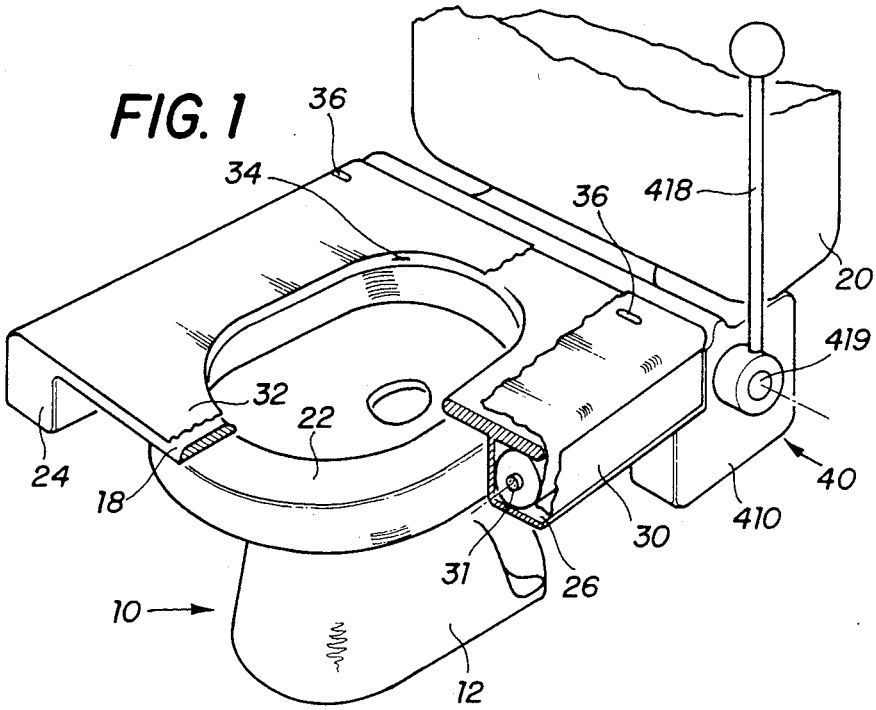
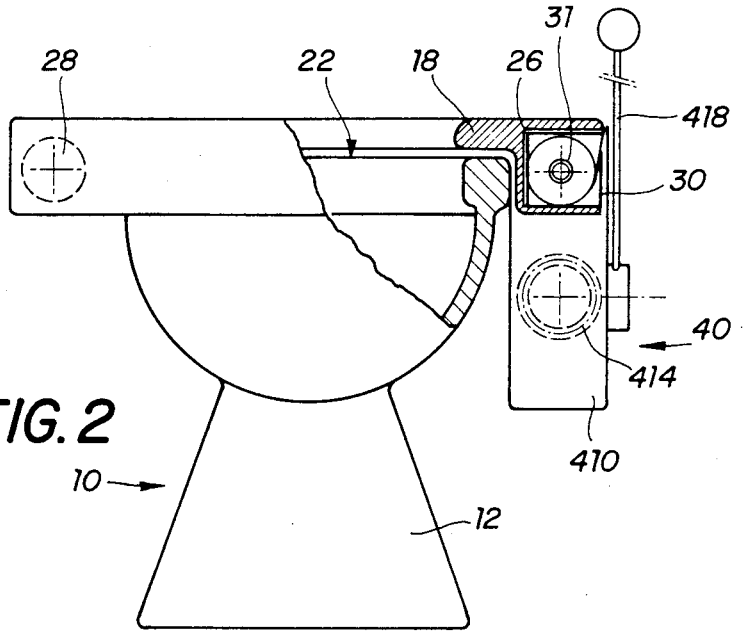
FIG. 2

418
20
14
31
30
422
420
17
412
414
12
40
416
410
10

28
14
20
24
32
16

12
16
26
30
422

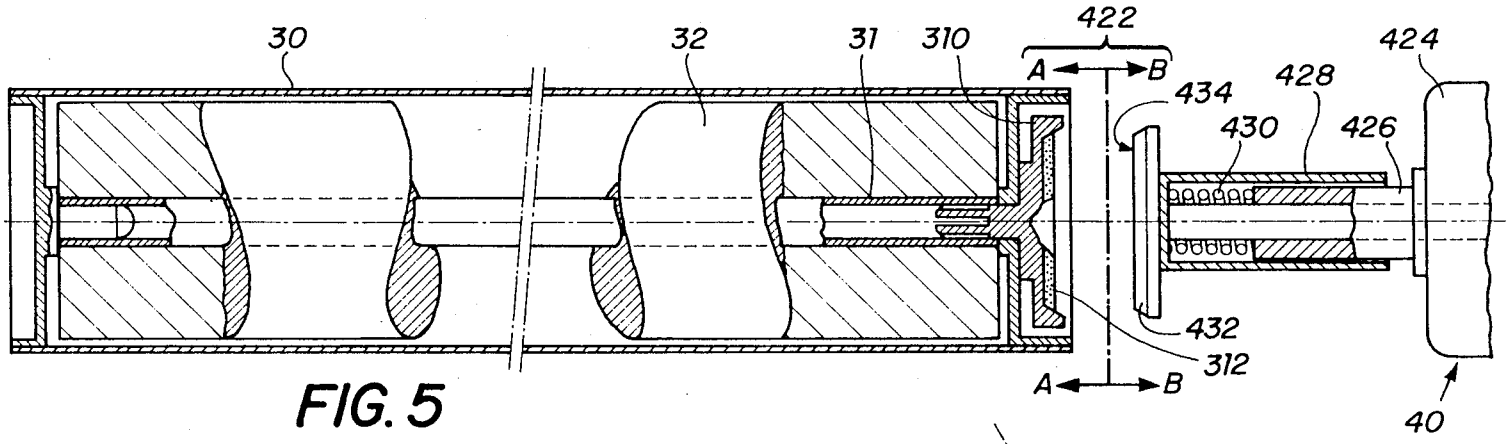
FIG. 5
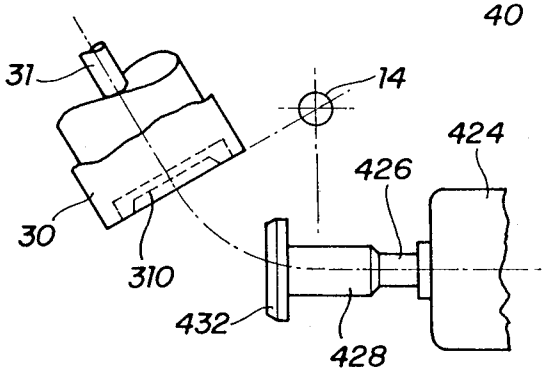
FIG. 8
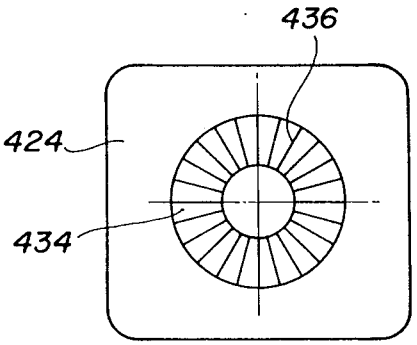
FIG. 7 (B-B)
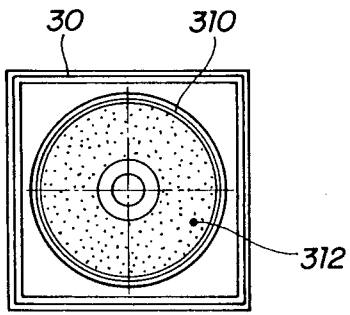
FIG. 6 (A-A)

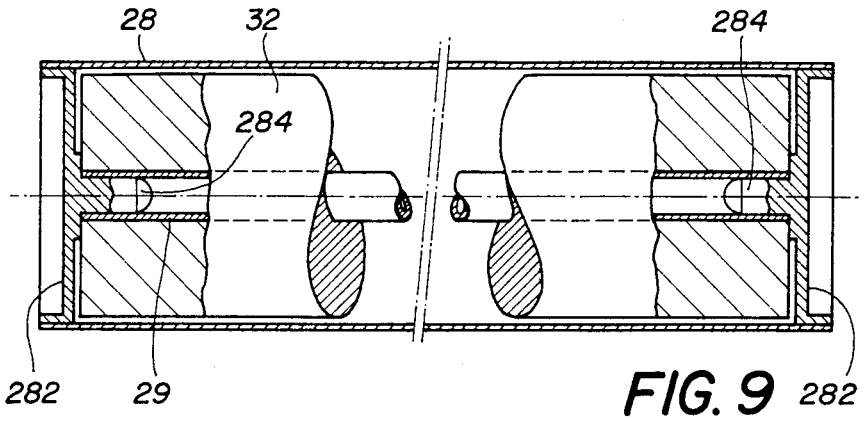
FIG. 9
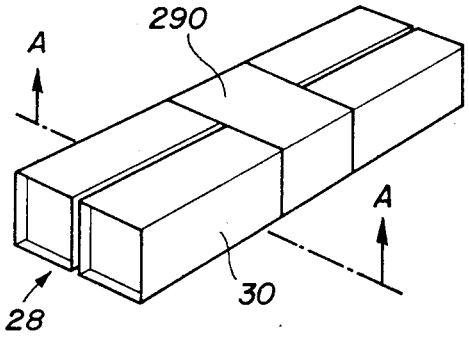
FIG. 10
FIG. 11
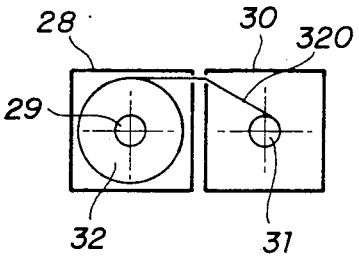
FIG. 12
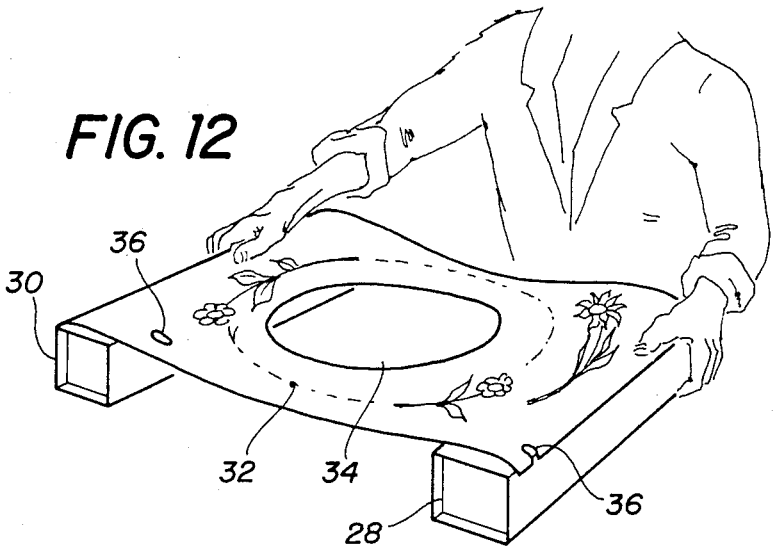

SANITARY CLOSET WITH TOILET SEAT PROTECTION COVER

This invention belongs to the field of sanitary technics and particularly refers to a water closet system comprising a toilet basin, a toilet seat on the basin, and an elevated flushing tank which may be fixed to the toilet room wall or partially or totally embedded in a clearance of the wall, or combined with the toilet basin. The invention is also applicable to dry closets.

The use of toilets, especially of public toilets, often not guarantees the necessary hygienic conditions. Seating on toilet seats may cause transmission of diseases, and basically, the aspect of a soiled toilet is disgusting and nauseous.

It has already been known to cover toilet seats with paper rings which are held available in some public or semi-public toilets, such as in restaurants. These paper rings do not remained fixed to the toilet seat in use, and they will block up the drain and sewage system should they fall into the toilet basin or be thrown therein.

Candian Patent Specification No. 1,184,542 (Neudorfer) discloses a sanitary seat cover dispensing apparatus comprising a housing cabinet to be disposed over the toilet seat containing therein a supply roll of a continuous strip of a plurality of toilet seat covers, and a rotatable take-up spool for receiving used seat covers. Said housing cabinet is an enormous and thus unesthetic box covering not only the toilet seat but the whole toilet basin or bowl until the floor of the toilet room; the use of such a toilet is uncomfortable.

West German Utility Model No. 7,000,474 (Thomas) describes a toilet seat with paper protection adapted to be unwound from a supply roll at one side of the toilet seat and to be wound up on a take-up spool on the other side of the seat, thus covering completely the seat. The paper protection comprises a continuous succession of openings adapted to the opening of the toilet seat. However, the changing of the paper supply and the take-up spools appears to be very difficult and troublesome in that the new paper strip must simultaneously be inserted in two different slots, one on each side of the toilet seat, which are as long as the paper width, and the protection paper will often tear or break up during insertion. Furthermore, there is a foot pedal with a driving mechanism for the take-up spool secured to the rear end of the take-up spool housing so that the whole mechanism is to be pivoted when the toilet seat is lifted.

It is a first and main object of the invention to provide an improved system for protecting toilet seats from being soiled and to protect the toilet user from being contaminated by unclean toilet seats.

A further object of this invention is to provide a new and improved hygienic toilet system allowing an uncomplicated and rapid change or insertion of a replacement unit of the protection cover.

Still another object of the invention is to provide a new and useful protection cover for the toilet seat in the form of a double cartridge wherein a protection cover web is hygienically stored until its use.

It is still another object of the invention to provide a new and improved soil protected toilet system wherein a protection cover web is transversely advanced by mechanical, electrical or pneumatical means over the complete surface of a toilet seat, these entrainment means being stationary but allowing nevertheless the upwardly folding up of the toilet seat.

These objects and still others are now met and implemented by the water closet of the invention which comprises a toilet seat having adapted thereto a first elongated lodgment for a supply cartridge containing a wound-up protection cover web at one side of the toilet seat, a second elongated lodgment for a take-up cartridge for used protection cover web at the other lateral side of the toilet seat, and means for advancing a predeterminated length of said cover web transversely over said toilet seat. The advancing means are stationary, and they are coupled to a take-up spool in the take-up cartridge when the toilet seat is in its lower position for use. Means are further provided to stop the advance motion of the protection cover web when a new opening in the web coincides with the opening of the toilet seat.

The invention further contemplates a cartridge assembly for being inserted into the said lodgments of the toilet seat. This cartridge assembly is composed of a pair of parallel cartridges joined together in alongside relationship, the supply cartridge containing a roll of the protection cover web wound up on a supply spool, and a take-up cartridge having a substantially empty take-up spool, the leading end of said protection cover web being introduced into the take-up cartridge and fixed to said take-up spool, the latter having coupling means adapted to cooperate with the protecting cover entrainment means fixed at the toilet installation.

The protection cover web is preferred to be made of a low-cost material adapted to a sole use, which does not interfere with environmental protection requirements. The most preferred material is wet-tear resistant paper, for example recycled paper, which may be printed with esthetical designs such as flowers. But alternatively, low-cost synthetic materials may also be used which are acceptable in terms of environmental protection, such as polyethylene or polypropylene. Of course, paper-synthetics blends may also be employed.

The entrainment means of the protection cover web act on the take-up spool in the take-up cartridge, by a coupling means allowing the folding-up of the toilet seat. These coupling means are preferred to be a frictional coupling, known per se, but any other mechanical or even magnetical coupling may be used.

The cartridge assembly consisting of a pair of cartridges which generally are tube having any desired cross-sectional shape such as circular, rectangular or square sections, is wrapped in such a manner that it will stay as a combined assembly but may easily be separated for the insertion on the toilet seat of the invention. This guarantees an absolutely hygienical storage of the fresh protection cover web, and furthermore, the two cartridges can easily be separated from each other, by spaced apart by hand, and easily be inserted simultaneously from above or from aside into their respective lodgments without any risk of damage during this operation.

The invention will now become easier and more complete to be understood by the description of preferred embodiments thereof which is given by way of example only; these examples are not construed to limit the invention to these embodiments. They are further shown in the drawing wherein:

FIG. 1 is a perspective view of a first embodiment of the toilet of this invention, the right-hand frontal portion being shown as broken away;

FIG. 2 is a partially sectioned front view of the toilet of FIG. 1;

FIG. 5 is a partially sectioned side view of a take-up cartridge for used protection cover web, showing the coupling mechanism;

FIG. 6 is a view of the cartridge of FIG. 5, seen in the direction A—A in FIG. 5;

FIG. 7 is a front view of the coupling means of FIG. 5, seen in the direction B—B in FIG. 5;

FIG. 8 is a schematcal view of an intermediate position of the mechanism of FIG. 5 during the lifting operation of the toilet seat;

FIG. 9 is a sectional side view of the supply cartridge;

FIG. 10 is a perspective view of the cartridge assembly before use;

FIG. 11 is a cross-sectional view in the plane defined by A—A in FIG. 10;

FIG. 12 is a perspective view of the opened and spaced cartridge assembly, ready for insertion into the toilet seat lodgments;

In the FIGURES, identical or similar parts have generally the same reference numerals.

Figure 3:
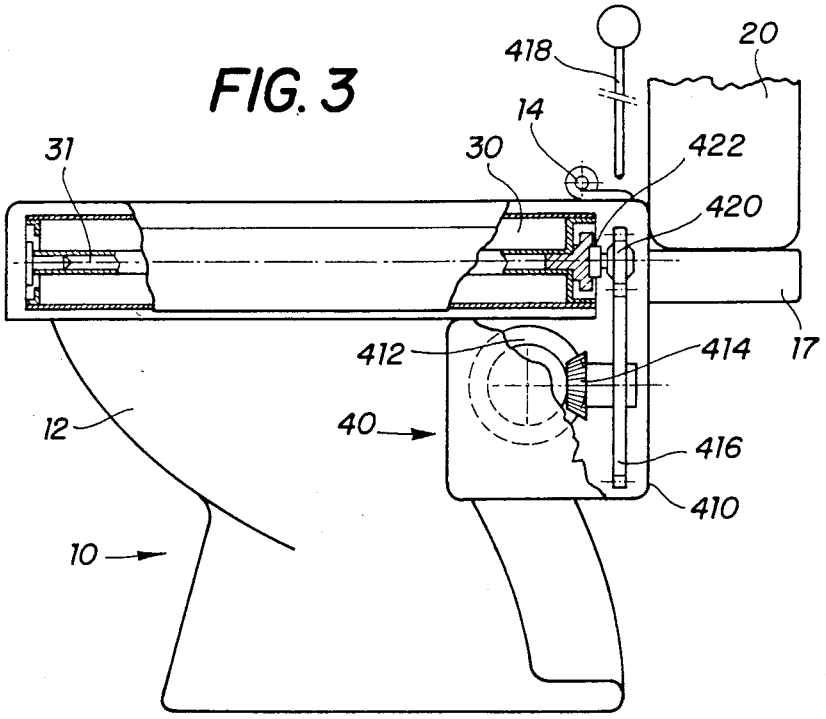
FIG. 3 is a lateral, partially sectioned view from the right side of the toilet shown in FIG. 1.
Figure 4:
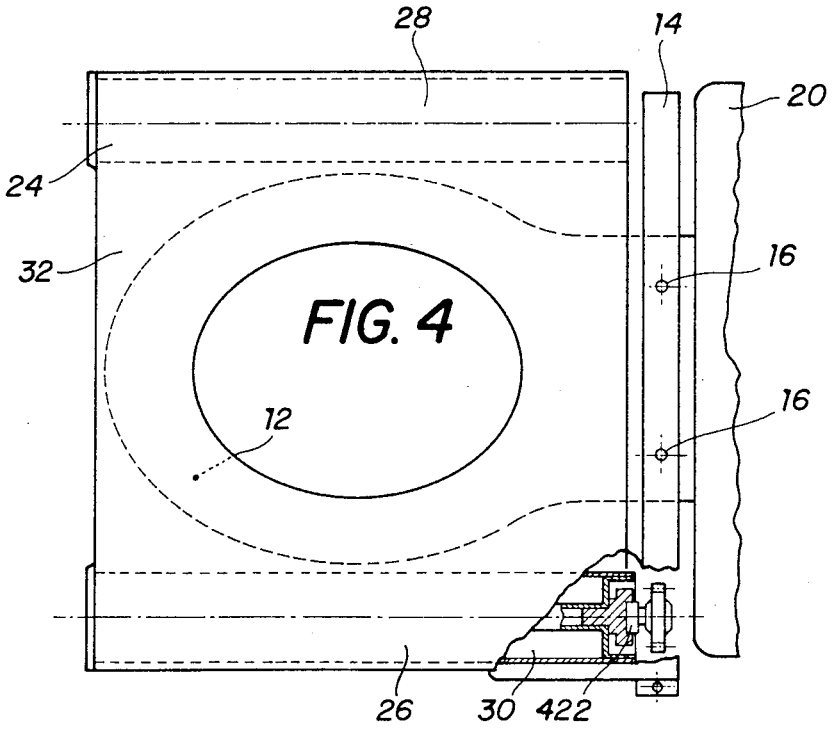
FIG. 4 is a partially sectioned top view of the toilet of FIG. 1.

A first embodiment of the toilet seat with appartaining parts is shown in FIGS. 1 to 12.

The toilet installation 10 comprises the toilet basin or bowl 12 which is well known and typically made of a ceramic material such as porcelain. A hinge arrangment 14 (FIG. 4) is secured with bolts 16 to the toilet basin 12. The toilet seat 18 is pivotably journalled in the hinge arrangement 14 and can be folded up in a known manner too. At the region behind the basin 12, a flush tank 20 is provided and is installed on the rear portion 17 of the toilet basin 12, or it may be fixed to the toilet room wall or even embedded into that wall. A folding-up toilet lid is typically also hinged in the arrangement 14 but is not shown in the drawing.

The toilet seat 18, overlapping the upper ring-shaped surface 22 of the basin 12, has a generally rectangular shape. On both lateral sides of the upper basin surface 22, a first and a second protection cover compartment 24, 26 is provided to receive, respectively, a supply cartridge 28 and a take-up cartridge 30; these cartridges will be described later.

A protection cover web 32 is drawn from the supply cartridge 28 over the toilet seat 18 into the take-up cartridge 30 (FIG. 1). An opening 34 is cut out of the web 32; this opening 34 is substantially congruent with the opening of the toilet seat 18; however, it is preferred that the opening 34 is slightly smaller than that of the seat so that the circumference of the seat 18 is covered by the web edges too. In the drawing, only one web opening 34 could be shown; the continuous web 32 contains of course a succeeding series of identical openings 34.

Furthermore, the web 32 is provided with appropriate position marks 36, shown as holes, and each hole 36 is associated in space relationship with an opening 34. The purpose of these marks 36 will be explained later.

The toilet installation further comprises an entrainment device 40 for the protection cover web 32. In the first embodiment, this entrainment device comprises a housing 410 mounted at the right-hand side in FIG. 1 beneath the upper board 22 of the basin (not shown). A gear composed of toothed wheels 412, 414 and 416 (FIG. 3) transmits the pivoting movement of a handle 418 to a gearwheel 420 whose axis is coaxial with the take-up spool 31 of the take-up cartridge 30. When pivoting the handle 418 forwardly and downwardly by about 90° about its axis 419, the gear 412 to 416 will transform this pivoting motion into a multiturn motion of the gearwheel 420 and, since the take-up spool 31 is coupled to that gearwheel by a clutch 422 (to be described later), the take-up spool will make a number of turns to wind up a predeterminated length of the web 32, in such a manner that an opening 34 which has exposed the opening of the toilet seat, will disappear in the take-up cartridge 30, and the next opening in the web 32 (not shown) will appear over the toilet seat 18.

Marks 36 in the web 32 will control the correct advance of the protection cover web so that there is always a correct overlapping of an opening 34 with that of the toilet seat. These marks may influence, in a manner known per se, an abutting stop of the handle 418 or the release of the clutch 422. The control mechanism is not shown.

The mechanical handle and gear entrainment device may be replaced by a pneumatical one.

FIGS. 5 to 8 represent in detail the entrainment mechanism of the take-up spool 31 and the construction of the take-up cartridge 30. In FIG. 5, the take-up cartridge 30 is shown in a slightly spaced position, in horizontal and axial direction, from its operating position.

The entrainment device 40 ends in the axis of the take-up spool 31 by a head 424 which is, in this embodiment, the frontal portion of an electric motor. The motor axle 426 bears a sleeve 428 closed at its frontal end and loaded by a compression spring 430 against the axle 426. A friction plate 432 is fixed to the frontal end of the sleeve 428. This plate has a frontal surface 434 provided with radial ribs 436 for improving its frictional properties (FIG. 7). On the other hand, the hollow take-up spool 31 is fitted at its frontal end with a circular plate 310 whose free surface has fixed thereon a friction disk 312 to cooperate with the friction plate 432.

When the cartridge 30 will be pushed home in its lodgment in the right-hand direction in FIG. 5, the friction disk 312 will come into contact with the friction plate 432. In pushing the cartridge further, the spring 430 will be compressed when the sleeve 428 is displaced in righthand direction, and the frictional force between the friction elements 312 and 434 will be increased. Thus, when the motor 424 is energized, the rotational movement of the axle 426 is frictionally transmitted to the take-up spool 31, and the web 32 will be wound up on this spool 31.

Should the toilet seat 18 be lifted and pivoted around the hinge axis 14 (FIG. 8), the friction disk 310 will become out of contact with the friction plate 432, and the toilet seat can fully be folded up leaving the entrainment device 424, 426, 428, which is stationary, in place.

FIG. 9 shows a section of the supply cartridge 28. The fresh web 32 forms a roll on the supply spool 29 which is a cardboard or plastics tube. The supply cartridge 28 is closed at both ends by closure plates 282 held in place by frictional forces or cemented or sealed to the walls of the cartridge body 28. Plastic stoppers 284 protude into the interior of the spool body 29 and serve as a bearing for the spool 29.

A supply and take-up cartridge assebmly is shown in perspective, schematical view in FIGS. 10 and 11. The supply and take-up cartridges 28 and 30 are arranged in side-by-side relationship and are joined by a wrapping paper 290. The supply cartridge 28 contains a roll of fresh web 32. The leading end 320 of the web 32 goes through slots in both cartridges and is attached to the take-up spool 32 (FIG. 11). Thus, when the wrapping 290 is removed, the user will seize the cartridges 28 and 30 with one hand each and pull then apart, see FIG. 12. A length of web 32 will unroll from the supply in cartridge 28, and the first opening 34 will appear. The assembly is now ready to be inserted into the cartridge lodgments of the toilet cover 18.

Figure 13:
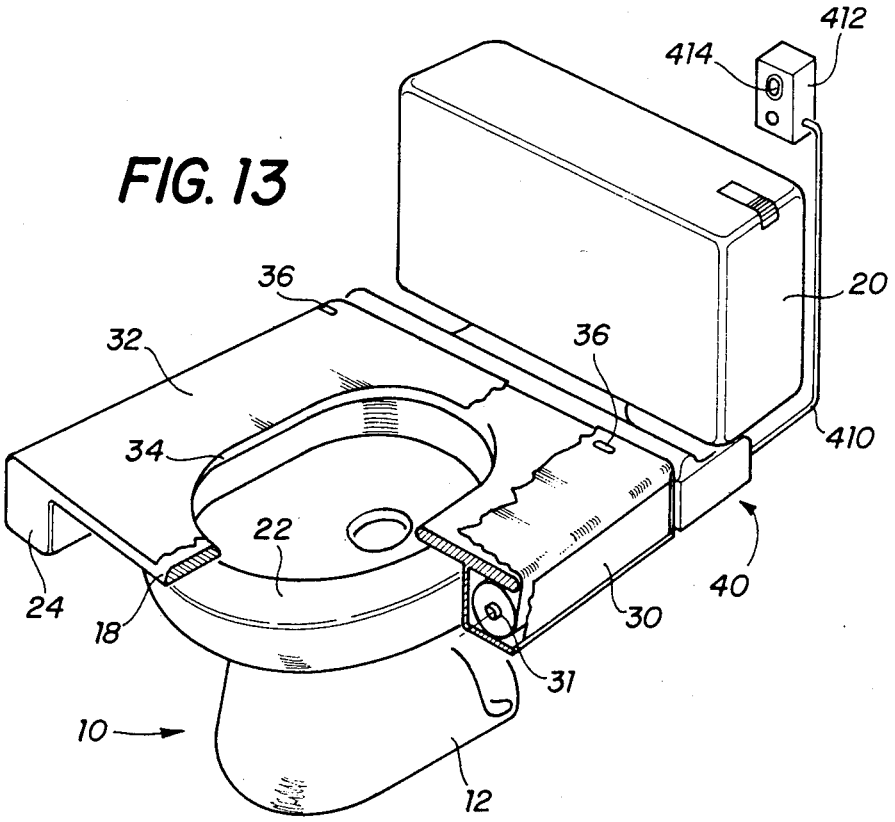
FIG. 13 is a perspective view of a second embodiment of the toilet according the invention, in the manner of FIG. 1 but equipped with an electric entrainment device of the protection cover web.

The second embodiment with electric motor drive is shown in perspective view in FIG. 13. Referring also to FIG. 5, the motor drive 40 is connected by a cable 410 to the electric box 412. This electric box contains a power device such as batteries, or serves as a connecting device to the mains installation. The pushbutton 414 will control the advance of used web 32 until a sensor device (not shown), which may be mechanical, optical or electrical and which cooperates with the stop marks 36, stops the motor 40 and guarantees that the web opening 34 coincides with the opening of the toilet seat 18.

Figure 14:
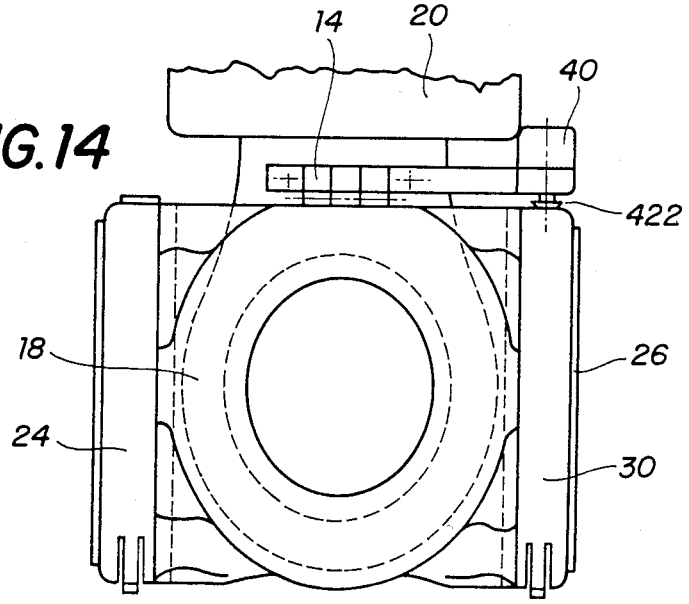
FIG. 14 is a top view of still another embodiment of the invention.

FIG. 14 is a top view of a third embodiment of the water closet of this invention. The toilet seat is shown in its normal, oval shape. The protection cover web is not represented. The lodgments 24 and 26 for the supply and the take-up cartridges, respectively, are arranged laterally to the seat 18 in the manner shown in FIGS. 1 and 13.

In all embodiments, the cartridges may be made of cardboard or synthetic materials, for example. The spools will be made of thin but resistant plastics. The web 32 is made of soft but tear and water resistent paper. It may be further reinforced against tear by a thin fiber or thread at both lengthwise edges of the web; this fiber may be of nylon.

Since the flushing tank 20 has no function with the protection cover of the invention, the toilet protection system may equally be adapted to dry closets such as in shelters.

What is claimed is:

1. In a sanitary closet installation comprising a toilet basin, a toilet seat hinged thereto for folding-up movement, and a protection cover web having lengthwise spaced-apart openings substantially congruent with the opening of said toilet seat, said protection cover web being adapted for lateral movement over said toilet seat from a supply spool, situated at one side of said seat, to a take-up spool situated at the other side of said seat, the improvements wherein said supply spool is contained in a removable supply cartridge and said take-up spool is contained in a removable take-up cartridge, both said cartridges being received in respective elongated lodgments arranged on both lateral sides of said toilet seat, said take-up spool contained in said take-up cartridge being removably coupled for rotational movement with entrainment means adapted for advancing a predetermined length of said web over said seat until the next following web opening is in place over the said toilet seat opening.

2. The sanitary closet installation of claim 1 wherein said entrainment means is fixed to said toilet seat.

3. The sanitary closet installation of claim 1 wherein said entrainment means is fixed to said toilet basin.

4. The sanitary closet installation of claim 1 wherein said entrainment means is an electric motor drive controlled by a pushbutton device.

5. The sanitary closet installation of claim 1 wherein said entrainment means is a mechanical drive comprising a handle to be swung from a substantially vertical position forwardly and downwardly by at most about 90°, said handle motion being transformed by a gear device into a multiturn rotational movement of said take-up spool.

6. The sanitary closet installation of claim 4 wherein said electric motor has an axle horizontally aligned with the axis of said take-up spool, said axle bearing a horizontally sliding, spring loaded sleeve on the frontal face of which is fixed a friction plate adapted to cooperate with a friction disk situated at the frontal face of said take-up cartridge, said friction disk being secured to said take-up spool.

7. The sanitary closet installation of claim 1 wherein said protection cover web comprises stop marks in spatial and operational relationship with said web openings.

8. The sanitary closet installation of claim 1 wherein said protection cover web comprises a continuous reinforcing thread at both lengthwise edge portions.

9. A cartridge assembly for the use with the sanitary closet installation of claim 1, comprising a supply cartridge containing a supply of a protection cover web having a plurality of lengthwise spaced-apart openings substantially congruent with the opening of a toilet seat, said web being rolled on a supply spool in the interior of said supply cartridge, said take-up cartridge further comprising coupling means adapted to cooperate with entrainment means of the sanitary closet installation, and a take-up cartridge containing an empty take-up spool, said web being guided out of said supply cartridge through a thin lengthwise slot in the supply cartridge and through a lengthwise slot in the take-up cartridge to said take-up spool and fixed thereto, said cartridges in said assembly being removably fixed together in side-by-side relationship.

10. The cartridge assembly of claim 9 wherein said coupling means comprise a friction disk mounted on the rear frontal end of said take-up spool.

* * * * *